United States Patent [19]

Camilleri

[11] 4,226,417

[45] Oct. 7, 1980

[54] CARPET BELT

[76] Inventor: Thomas M. Camilleri, 277 Avenue W, Brooklyn, N.Y. 11223

[21] Appl. No.: 912,391

[22] Filed: Jun. 5, 1978

Related U.S. Application Data

[63] Continuation-in-part of Ser. No. 712,182, Aug. 6, 1976, abandoned, which is a continuation-in-part of Ser. No. 594,194, Jul. 9, 1975, abandoned.

[51] Int. Cl.[3] ..... A63D 5/02; A63D 5/08

[52] U.S. Cl. ..... 273/43 R; 198/847

[58] Field of Search ..... 273/43 R, 43 A, 49; 198/844, 846, 847

[56] References Cited

U.S. PATENT DOCUMENTS

| | | | |
|---|---|---|---|
| 2,622,879 | 12/1952 | Frye | 273/43 R |
| 2,850,149 | 9/1958 | Bankauf | 198/846 X |
| 3,036,944 | 5/1962 | White et al. | 273/49 UX |
| 3,199,870 | 8/1965 | Fried | 273/43 R |

*Primary Examiner*—Anton O. Oechsle

*Attorney, Agent, or Firm*—Donald J. Perrella

[57] ABSTRACT

A carpet belt for an automatic pinspotter machine formed of a soft, flexible, material capable of embedding therein a hard object without being torn.

13 Claims, 2 Drawing Figures

CARPET BELT

RELATED APPLICATIONS

This application is a continuation-in-part of my copending application Ser. No. 712,182 filed Aug. 6, 1976, now abandoned, which in turn was a continuation-in-part of my copending application Ser. No. 594,194, filed July 9, 1975, now abandoned.

BACKGROUND OF THE INVENTION

This invention relates to an automatic pinspotter machine. More particularly, it relates to the carpet belt for an automatic pinspotter machine.

In one type of automatic pinspotter machine bowling pins struck by the ball may fall on the lane or be driven past the end of the pin deck of the lane toward the rear of the pinsetting machine. Those fallen pins that remain on the pin deck of the lane are swept off the lane by a sweep mechanism. In either case, once past the end of the pin deck the pins lie on a carpet belt which is a band of tough, relatively inflexible material which carries the pins to the pickup mechanism at the rear of the machine. Such a carpet belt will have a hard surface and may be composed of plies or layers of fabric bonded together by a coat of rubber. It may also consist of a single interwoven ply, cords of material, or a combination of both. The carpet belt is mounted on two cylinders to form a continuous endless loop from the end of the pin deck of the bowling lane to the pickup mechanism at the rear of the machine—a distance of approximately three feet. Located directly above the carpet belt are many moving parts of the pinspotter machine. Any foreign objects or loosened parts of the pinspotter machine, e.g., screws, nuts, bolts, or neglected tools that fall onto the carpet belt are carried to the rear of the pinspotter machine to the space between the carpet belt and the metal housing of the pin elevator wheel. If such objects are small enough, they pass through the space and are carried by the carpet around the cylinder and fall beneath the machine where they do no damage. If such foreign objects are not small enough to pass through the space, however, they become partly wedged in the space and cut the carpet belt as it continues to be driven by the cylinders. This cutting is due to the hard and inelastic surface of the carpet belts now being used in this type of pinspotter machine. A torn carpet functions improperly and must either be repaired or replaced. Replacement of the carpet belt requires skilled personnel to dismantle the machine and manually remove the carpet belt. In certain cases when the tear is not severe a temporary repair may be performed on the carpet belt. Whichever remedy is required the task is difficult, time consuming and costly.

Whether or not the carpet belt is torn, it is sometimes necessary to repair the bounce-plate mechanism which is located beneath the carpet belt between the two cylinders on which the carpet belt is mounted. Before the repair can be made, the difficult and time-consuming task of removing the carpet belt must be effected.

The conventional carpet belts are also subject to sagging, to fraying along their edges, and to separation along the seam where the two ends are joined. The occurrence of any of the foregoing interferes with delivery of the pins to the pickup mechanism and of the ball to the ball return mechanism.

OBJECTS OF THE INVENTION

It is an object of the present invention to provide an improved carpet belt for a pinspotter machine. A further object is to provide a carpet belt which is resistant to tearing and cutting by foreign objects. Another object is to provide a carpet belt which is not subject to fraying or separation and which resists sagging. Still another object is to provide a carpet belt which has considerably more longevity and is more easily installed and removed. These and other objects of the present invention will be apparent from the following description.

SUMMARY OF THE INVENTION

It has now been found that the foregoing objects are achieved and the disadvantages of prior art overcome by forming the carpet belt of a soft, flexible, material capable of embedding therein a hard object without being torn.

DETAILED DESCRIPTION

Figure 1:
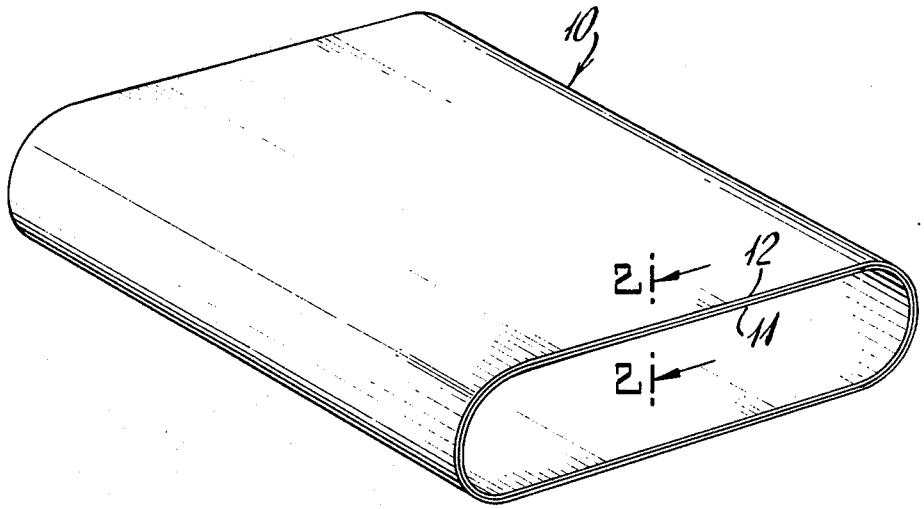
FIG. 1 is a perspective view of a carpet belt of the present invention.
Figure 2:
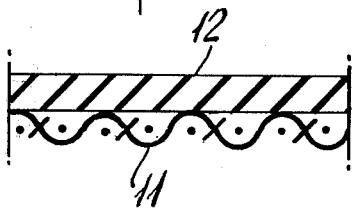
FIG. 2 is a cross section taken along the line A—A of FIG. 1.

The carpet belt of the present invention is formed of a soft, flexible, material capable of being distorted by a hard object to the extent that the object is embedded in the carpet belt without tearing the carpet belt.

The carpet belt of the present invention may be formed of natural rubber or its synthetic counterpart polyisoprene, neoprene, nitrile-butadiene rubber, butyl rubber, chlorinated butyl rubber, polyurethane and the like. The carpet belt may have a durometer hardness of from about 30 to about 75. The pin contacting surface of the carpet belt 10 of the present invention is not made of canvas or rubber-impregnated canvas or plies or layers of such hard materials but is formed instead of a soft flexible elastomer 12 formed of one or more of the materials mentioned previously optionally bonded to an inner backing 11 of backing material, e.g., canvas duck, which does not contribute to the functioning of the outer layer 12 but prevents layer 12 from stretching and slipping on the drive cylinders. It is not subject to fraying at the edges. The carpet belt of the present invention may also lack a seam as it may be formed of a single continuous, endless band. As a result there is no danger of seam separation. The backing layer 11 may be attached to layer 12 by any suitable means, e.g., stitching, adhesives, or by placing both inner layer 11 and outer layer 12 on a mandrel and curing outer layer 12.

If a foreign objects such as, e.g., a screw, nut, bolt, or tool which falls on the carpet belt of the present invention is small enough to be pulled through the space between the carpet belt and the housing of pin elevator wheel and deposited under the carpet belt, no damage is caused to the carpet belt. If the foreign object is too large to fit in the space it will stay on top of the carpet belt causing no damage to the carpet belt. If, however, the object is of an inbetween size rather than the cutting or tearing that occurs with conventional carpet belts, the foreign object compresses the carpet belt as it contacts the housing surface adjacent the carpet belt and becomes wedged tightly in the space between the housing surface and the carpet belt. Once the foreign object is wedged in the space, the motor does not have sufficient power to compress the object, usually made of steel, or to distort the steel cylinders or to distort the metal housing in order to continue driving the cylinders. As a result the cylinders are prevented from turning thereby causing an overload on the drive motor which cuts off its electric power and stops the pinspotter machine. If the foreign object is not noticed and the overload reset button activated to restart the motor, it will again overload and stop, thereby alerting the attendant to the presence of a foreign object. Removal of the foreign object permits the motor to be restarted with no damage done either to the carpet belt or the drive motor.

In some instances the wedging of the foreign object instead of overloading the motor may cause the cylinder drive pulley to slip or one of the safety overload switches may be activated. In any event, however, the desired result is obtained, namely, the cylinders stop turning thereby preventing the carpet belt from being damaged.

In one embodiment the carpet belt of the present invention may have a tensile strength of at least about 1,000 psi and a modulus of elasticity when subjected to the forces indicated below as follows:

| Force | Elongation |
|---|---|
| 300 psi | 200% |
| 450 psi | 300% |
| 677 psi | 400% |

Its breaking point occurs at a elongation of about 550%.

Because of its relative flexibility, the carpet belt of the present invention can be installed and removed more readily than can the relatively inflexible conventional carpet belts. Repairs to the bounce-plate are difficult when conventional carpet belts are used as such carpet belts must be completely removed which necessitates dismantling the unit. Such dismantling of the unit is not necessary in the case of the flexible carpet belt of the present invention which need not be completely removed but only folded over on itself to expose the bounce plate. The carpet belt of the present invention is, moreover, much more oil resistant than conventional carpet belts, less likely to sag or to fray.

The following examples illustrate the present invention without, however, limiting the same thereto.

EXAMPLE 1

A continuous, endless, seamless carpet belt formed of sheet rubber, 54 inches wide, and ⅛ inch thick which has been cured on a Mandrell in known fashion and bonded to an inner layer of No. 22 canvas duck about ⅛ inch thick is mounted on the cylinders of an automatic pinspotter machine. The carpet belt has a durometer hardness of 60–65, a tensile strength of 2,225 lbs/sq. in. and an elongation of 200% at a force of 300 psi. The machine is turned on and a bolt approximately ⅝ of an inch, is deliberately dropped onto the carpet belt. As the bolt reaches the space between the carpet belt and the metal housing of the pin elevator wheel, the bolt compresses the carpet belt and is wedged tightly in the space stopping the motor and the carpet belt. The bolt is then removed and no tearing or cutting of the carpet belt is observed, nor has any damage occurred to the motor.

While the foregoing carpet belt describes specific hardness, tensile strength and modulus of elasticity, it is to be understood that these properties may be varied as long as the carpet belt performs the essential function of being compressed by a foreign object thus wedging the object tightly into the space between the carpet belt and the metal housing and preventing the cylinder from turning.

EXAMPLE 2

The procedure of Example 1 is repeated on a automatic pinspotter machine having a conventional carpet belt. In this case, the motor fails to stall and the bolt cuts into the carpet belt destroying the carpet belt. The machine has to be manually stopped.

What is claimed is:

1. In an automatic pinspotter machine having a carpet belt for conveying pins from the end of the lane to the pin elevator wheel and a motor to drive cylinders on which the carpet belt is mounted, the pin elevator wheel having a housing surface adjacent the carpet belt, the improvement wherein the pin contacting surface of the carpet belt comprises a soft, flexible, elastomeric material having a durometer hardness of from about 30 to about 75 capable of embedding therein a hard object without being torn and of firmly wedging the hard object between the carpet belt and the housing surface of the pin elevator wheel.

2. A carpet belt according to claim 1 wherein the elastomer is natural rubber, polyisoprene, neoprene, nitrile-butadiene rubber, butyl rubber, chlorinated butyl rubber, or polyurethane.

3. A carpet belt according to claim 1 wherein the soft flexible material is attached to an inner layer of backing material.

4. In an automatic pinspotter machine having a carpet belt for conveying pins from the end of the lane to the pin elevator wheel and a motor to drive cylinders on which the carpet belt is mounted, the pin pickup mechanism having a housing surface adjacent the carpet belt, the improvement wherein the carpet belt comprises a soft, flexible elastomeric material capable of being folded on itself while still mounted on the cylinders and capable of embedding a hard metallic object without being torn by the hard metallic object and of firmly wedging the hard metallic object into the space between the carpet belt and the housing surface of the pin elevator wheel whereby substantial damage to the carpet belt is avoided.

5. A carpet belt according to claim 4 having a tensile strength of at least about 1,000 lbs/sq. in.

6. A carpet belt according to claim 4 having a durometer hardness of from about 30 to about 75.

7. A carpet belt according to claim 4 formed of natural rubber, polyisoprene, neoprene, nitrile-butadiene rubber, butyl rubber, chlorinated butyl rubber, or urethane.

8. A carpet belt according to claim 4 wherein the elastomeric material is attached to an inner layer of backing material.

9. In an automatic pinspotter machine having a carpet belt for conveying pins from the end of the lane to the pin elevator wheel and a motor to drive cylinders on which the carpet belt is mounted, the pin elevator wheel having a housing surface adjacent the carpet belt, the improvement wherein the pin contacting surface of the carpet belt comprises a soft, flexible, elastomeric material having a tensile strength of at least about 1,000 lbs./sq. in. capable of embedding therein a hard object without being torn and of firmly wedging the hard object between the carpet belt and the housing surface of the pin elevator wheel.

10. In an automatic pinspotter maching having a carpet belt for conveying pins from the end of the lane to the pin elevator wheel and a motor to drive cylinders on which the carpet belt is mounted, the pin elevator wheel having a housing surface adjacent the carpet belt, the improvement wherein the pin contacting surface of the carpet belt comprises a soft, flexible, elastomeric material having a modulus of elasticity of about 200% when subjected to a force of about 300 psi capable of embedding therein a hard object without being torn and of firmly wedging the hard object between the carpet belt and the housing surface of the pin elevator wheel.

11. A carpet belt according to claim 9 wherein the elastomer is natural rubber, polyisoprene, neoprene, nitrile-butadiene rubber, butyl rubber, chlorinated butyl rubber, or polyurethane.

12. A carpet belt according to claim 10 wherein the elastomer is natural rubber, polyisoprene, neoprene, nitrile-butadiene rubber, butyl rubber, chlorinated butyl rubber, or polyurethane.

13. A carpet belt according to claim 10 wherein the soft flexible material is attached to an inner layer of backing material.

* * * * *